US007500371B2

(12) United States Patent
Andres et al.

(10) Patent No.: US 7,500,371 B2
(45) Date of Patent: Mar. 10, 2009

(54) LOCKING DEVICE WITH PASSAGE

(75) Inventors: Guillermo Andres, Pleasanton, CA (US); Lambert Kuo, Tainan (TW)

(73) Assignee: Acco Brands USA LLC, Lincolnshire, IL (US)

( * ) Notice: Subject to any disclaimer, the term of this patent is extended or adjusted under 35 U.S.C. 154(b) by 150 days.

(21) Appl. No.: 11/283,322

(22) Filed: Nov. 18, 2005

(65) Prior Publication Data

US 2007/0113608 A1 May 24, 2007

(51) Int. Cl.
*E05B 27/00* (2006.01)

(52) U.S. Cl. ..... 70/491; 70/404; 70/416; 70/419; 70/421

(58) Field of Classification Search ..... 70/58, 70/491, 404, 416, 418–421
See application file for complete search history.

(56) References Cited

U.S. PATENT DOCUMENTS

| | | | |
|---|---|---|---|
| 87,045 | A | 2/1869 | Holmes |
| 285,074 | A | 9/1883 | Rhoades et al. |
| 505,299 | A | 9/1893 | Schneider |
| 606,734 | A | 7/1898 | Olmstead |
| 611,646 | A | 10/1898 | Parker |
| 786,842 | A | 4/1905 | Robeson |
| 881,364 | A | 3/1908 | Wheeler |
| 934,928 | A | 9/1909 | Michel |
| 942,537 | A | 12/1909 | Batdorf |
| 952,411 | A | 3/1910 | Billy |
| 1,004,333 | A | 9/1911 | Alsterberg |
| 1,050,276 | A | 1/1913 | Johnson |
| 1,101,450 | A | 6/1914 | Kerry |
| 1,432,546 | A | 10/1922 | Gillom |
| 1,452,471 | A | 4/1923 | Kline |
| 1,470,937 | A | 10/1923 | Schou |
| 1,534,936 | A | 4/1925 | Fishchbach |
| 1,672,333 | A | 6/1928 | Miller |
| 1,786,511 | A | 12/1930 | Warren |
| 2,001,354 | A | 5/1935 | Smith |
| 2,102,583 | A | 12/1937 | Alberg |
| 2,109,109 | A | 2/1938 | Finch |
| 2,130,216 | A | 9/1938 | Zaninovich |

(Continued)

FOREIGN PATENT DOCUMENTS

| | | |
|---|---|---|
| CA | 454901 | 3/1949 |

(Continued)

OTHER PUBLICATIONS

U.S. Appl. No. 09/007,221, Murray, Jr. et al.

(Continued)

*Primary Examiner*—Suzanne D Barrett
(74) *Attorney, Agent, or Firm*—Townsend and Townsend and Crew LLP

(57) ABSTRACT

A lock device for use with a key is disclosed. The lock device includes a locking spindle including a plurality of locking spindle bores and a passage extending axially along an axial length of the locking spindle, and a driver structure including a plurality of driver structure bores. An interface between the driver structure and the locking spindle forms a shear line. The lock device also includes a plurality of combination pins in the plurality of locking spindle bores, and a plurality of driver pins in the driver structure bores in the driver structure, the plurality of driver pins being respectively associated with the plurality of combination pins.

16 Claims, 6 Drawing Sheets

U.S. PATENT DOCUMENTS

| | | | | |
|---|---|---|---|---|
| 2,172,208 | A | | 9/1939 | Kutrzon |
| 2,190,661 | A | | 2/1940 | Hauer |
| 2,383,397 | A | | 8/1945 | Lofquist |
| 2,405,400 | A | | 8/1946 | Butterfiled |
| 2,435,876 | A | | 2/1948 | De Swart |
| 2,469,874 | A | | 5/1949 | Fetsko, Jr. |
| 2,480,662 | A | | 8/1949 | McKinzie |
| 2,530,560 | A | | 11/1950 | Young |
| 2,577,956 | A | | 12/1951 | Elsberg |
| 2,594,012 | A | | 4/1952 | Griffin |
| 2,660,084 | A | | 11/1953 | Newman |
| 2,677,261 | A | | 5/1954 | Jacobi |
| 2,729,418 | A | | 1/1956 | Maynard |
| 2,800,090 | A | | 7/1957 | Reid |
| 2,963,310 | A | | 12/1960 | Abolins |
| 3,091,011 | A | | 5/1963 | Campbell |
| 3,101,695 | A | | 8/1963 | Honeyman, Jr. |
| 3,130,571 | A | | 4/1964 | Neumann |
| 3,136,017 | A | | 6/1964 | Preziosi |
| 3,171,182 | A | | 3/1965 | Danehy |
| 3,174,384 | A | | 3/1965 | Vanni |
| 3,200,694 | A | | 8/1965 | Rapata |
| 3,211,408 | A | | 10/1965 | Schaefer |
| 3,213,745 | A | | 10/1965 | Dwyer |
| 3,220,077 | A | | 11/1965 | Newcomer, Jr. et al. |
| 3,276,835 | A | | 10/1966 | Hall |
| 3,469,874 | A | | 9/1969 | Mercurio |
| 3,486,158 | A | | 12/1969 | Soltysik et al. |
| 3,521,845 | A | | 7/1970 | Sweda et al. |
| 3,590,608 | A | | 7/1971 | Smyth et al. |
| 3,625,031 | A | | 12/1971 | Alley, III |
| 3,634,963 | A | | 1/1972 | Hermann |
| 3,664,163 | A | | 5/1972 | Foote |
| 3,722,239 | A | | 3/1973 | Mestre |
| 3,727,934 | A | | 4/1973 | Averbook et al. |
| 3,737,135 | A | | 6/1973 | Bertolini |
| 3,754,420 | A | | 8/1973 | Oellerich |
| 3,765,197 | A | | 10/1973 | Foote |
| 3,771,338 | A | | 11/1973 | Raskin |
| 3,772,645 | A | | 11/1973 | Odenz et al. |
| 3,782,146 | A | | 1/1974 | Franke |
| 3,785,183 | A | | 1/1974 | Sander |
| 3,798,934 | A | | 3/1974 | Wright et al. |
| 3,826,510 | A | | 7/1974 | Halter |
| D232,416 | S | | 8/1974 | Gazda et al. |
| 3,836,704 | A | | 9/1974 | Coules |
| 3,859,826 | A | | 1/1975 | Singer et al. |
| 3,866,873 | A | | 2/1975 | Bohli |
| 3,875,645 | A | | 4/1975 | Tucker et al. |
| 3,905,570 | A | | 9/1975 | Nieuwveld |
| 3,910,079 | A | | 10/1975 | Gassaway |
| 3,910,081 | A | | 10/1975 | Pender |
| 3,939,752 | A | | 2/1976 | Koscik |
| 3,986,780 | A | | 10/1976 | Nivet |
| 3,990,276 | A | | 11/1976 | Shontz |
| 3,999,410 | A | | 12/1976 | Hall |
| 4,003,228 | A | | 1/1977 | Lievens et al. |
| 4,004,440 | A | | 1/1977 | Dreyer |
| 4,007,613 | A | | 2/1977 | Gassaway |
| 4,018,339 | A | | 4/1977 | Pritz |
| 4,028,913 | A | | 6/1977 | Falk |
| 4,028,916 | A | | 6/1977 | Pender |
| 4,047,748 | A | | 9/1977 | Whaley et al. |
| 4,055,973 | A | | 11/1977 | Best |
| 4,057,984 | A | | 11/1977 | Avaiusini |
| 4,065,083 | A | | 12/1977 | Gassaway |
| 4,066,195 | A | | 1/1978 | Dickler |
| 4,066,231 | A | | 1/1978 | Bahner |
| 4,104,951 | A | | 8/1978 | Leitner |
| 4,112,820 | A | * | 9/1978 | Conger et al. ..... 70/491 |
| 4,114,409 | A | | 9/1978 | Scire |
| 4,118,902 | A | | 10/1978 | Saxton |
| 4,123,922 | A | | 11/1978 | Kuenstler |
| 4,131,001 | A | | 12/1978 | Gotto |
| 4,212,175 | A | | 7/1980 | Zakow |
| 4,223,542 | A | | 9/1980 | Basseches |
| 4,252,007 | A | | 2/1981 | Kerley |
| 4,263,833 | A | | 4/1981 | Loudin |
| 4,300,371 | A | | 11/1981 | Herwick et al. |
| 4,311,883 | A | | 1/1982 | Kidney |
| 4,337,462 | A | | 6/1982 | Lemelson |
| 4,391,110 | A | | 7/1983 | Nielson |
| 4,394,101 | A | | 7/1983 | Richer |
| 4,418,550 | A | | 12/1983 | Hamilton |
| 4,419,034 | A | | 12/1983 | DiMartino |
| 4,442,571 | A | | 4/1984 | Davis et al. |
| 4,448,049 | A | | 5/1984 | Murray |
| 4,462,233 | A | | 7/1984 | Horetzke |
| 4,466,259 | A | | 8/1984 | Osgood |
| 4,471,980 | A | | 9/1984 | Hickman |
| 4,478,545 | A | | 10/1984 | Mizusawa |
| 4,501,460 | A | | 2/1985 | Sisler |
| 4,527,405 | A | | 7/1985 | Renick et al. |
| 4,570,465 | A | | 2/1986 | Bennett |
| 4,579,492 | A | | 4/1986 | Kazino |
| 4,584,856 | A | | 4/1986 | Petersdorff et al. |
| 4,586,843 | A | | 5/1986 | Henge et al. |
| 4,593,273 | A | | 6/1986 | Narcisse |
| 4,598,272 | A | | 7/1986 | Cox |
| 4,603,829 | A | | 8/1986 | Koike et al. |
| 4,610,587 | A | | 9/1986 | Wollar |
| 4,616,490 | A | | 10/1986 | Robbins |
| 4,640,106 | A | | 2/1987 | Derman |
| 4,653,297 | A | * | 3/1987 | Moorhouse ..... 70/491 |
| 4,655,057 | A | | 4/1987 | Derman |
| 4,656,848 | A | | 4/1987 | Rose |
| 4,667,491 | A | | 5/1987 | Lokken et al. |
| 4,676,080 | A | | 6/1987 | Schwarz |
| 4,680,949 | A | | 7/1987 | Stewart |
| 4,685,312 | A | | 8/1987 | Lakoski et al. |
| 4,691,891 | A | | 9/1987 | Dionne |
| 4,692,968 | A | | 9/1987 | Girard |
| 4,704,881 | A | | 11/1987 | Sloop, Sr. |
| 4,733,840 | A | | 3/1988 | D'Amore |
| 4,738,428 | A | | 4/1988 | Themistos et al. |
| 4,741,185 | A | | 5/1988 | Weinert et al. |
| 4,768,361 | A | | 9/1988 | Derman |
| 4,770,583 | A | | 9/1988 | Lindberg |
| 4,779,434 | A | | 10/1988 | Derman |
| 4,785,291 | A | | 11/1988 | Hawthorne |
| 4,801,232 | A | | 1/1989 | Hempel |
| 4,804,943 | A | | 2/1989 | Soleimani |
| 4,805,426 | A | | 2/1989 | Dimmick et al. |
| 4,813,252 | A | | 3/1989 | Ray |
| 4,826,193 | A | | 5/1989 | Davis |
| 4,834,600 | A | | 5/1989 | Lemke |
| 4,842,912 | A | | 6/1989 | Hutter, III |
| 4,843,848 | A | | 7/1989 | Igelmund |
| 4,856,304 | A | | 8/1989 | Derman |
| 4,856,305 | A | | 8/1989 | Adams |
| 4,858,455 | A | | 8/1989 | Kuo |
| 4,862,716 | A | | 9/1989 | Derman |
| 4,870,840 | A | | 10/1989 | Klein |
| 4,893,488 | A | | 1/1990 | Klein |
| 4,907,111 | A | | 3/1990 | Derman |
| 4,907,716 | A | | 3/1990 | Wankel et al. |
| 4,918,952 | A | | 4/1990 | Lakoski et al. |
| 4,924,683 | A | | 5/1990 | Derman |
| 4,924,693 | A | | 5/1990 | College |
| 4,938,040 | A | | 7/1990 | Humphreys, Jr. |
| 4,959,635 | A | | 9/1990 | Wilson |
| 4,959,979 | A | | 10/1990 | Filipow et al. |
| 4,964,285 | A | | 10/1990 | Lakoski |
| 4,966,511 | A | | 10/1990 | Lee |

| | | | |
|---|---|---|---|
| 4,978,265 | A | 12/1990 | DeWan |
| 4,979,382 | A | 12/1990 | Perry |
| 4,985,695 | A | 1/1991 | Wilkinson et al. |
| 4,986,097 | A | 1/1991 | Derman |
| 4,993,244 | A | 2/1991 | Osman |
| 5,001,460 | A | 3/1991 | Basson |
| 5,001,854 | A | 3/1991 | Derman |
| 5,010,748 | A | 4/1991 | Derman |
| 5,022,242 | A | 6/1991 | Povilaitis |
| 5,024,072 | A | 6/1991 | Lee |
| 5,027,627 | A | 7/1991 | Derman |
| 5,050,836 | A | 9/1991 | Makous |
| 5,052,199 | A | 10/1991 | Derman |
| 5,063,763 | A | 11/1991 | Johnson |
| 5,067,151 | A | 11/1991 | Inagaki |
| 5,076,079 | A | 12/1991 | Monoson |
| 5,082,232 | A | 1/1992 | Wilson |
| 5,082,233 | A | 1/1992 | Ayers et al. |
| 5,099,663 | A | 3/1992 | Dearstine |
| 5,117,661 | A | 6/1992 | Carl et al. |
| 5,119,649 | A | 6/1992 | Spence |
| 5,135,197 | A | 8/1992 | Kelley et al. |
| 5,138,785 | A | 8/1992 | Paterson |
| 5,146,769 | A | 9/1992 | Smith |
| 5,154,456 | A | 10/1992 | Moore |
| 5,184,798 | A | 2/1993 | Wilson |
| 5,197,706 | A | 3/1993 | Braithwaite et al. |
| 5,223,815 | A | 6/1993 | Rosenthal et al. |
| D337,040 | S | 7/1993 | Carl |
| 5,228,319 | A | 7/1993 | Holley et al. |
| 5,279,136 | A | 1/1994 | Perry |
| 5,317,304 | A | 5/1994 | Choi |
| 5,327,752 | A | 7/1994 | Myers et al. |
| D350,473 | S | 9/1994 | Simon |
| 5,349,834 | A | 9/1994 | Davidge |
| 5,351,507 | A | 10/1994 | Derman |
| 5,351,508 | A | 10/1994 | Kelley |
| 5,361,610 | A | 11/1994 | Sanders |
| 5,370,488 | A | 12/1994 | Sykes |
| 5,377,512 | A | 1/1995 | Kelley |
| 5,381,685 | A | 1/1995 | Carl et al. |
| 5,390,514 | A | 2/1995 | Harmon |
| 5,390,977 | A | 2/1995 | Miller |
| 5,394,713 | A | 3/1995 | Harmon |
| 5,397,171 | A | 3/1995 | Leach |
| 5,398,530 | A | 3/1995 | Derman |
| 5,400,622 | A | 3/1995 | Harmon |
| 5,406,809 | A | 4/1995 | Igelmund |
| 5,412,959 | A | 5/1995 | Bentley |
| 5,421,667 | A | 6/1995 | Leyden et al. |
| 5,447,049 | A | 9/1995 | Shien |
| 5,466,022 | A | 11/1995 | Derman |
| 5,489,173 | A | 2/1996 | Hofle |
| 5,493,878 | A | 2/1996 | Murray et al. |
| 5,502,989 | A | 4/1996 | Murray et al. |
| 5,520,031 | A | 5/1996 | Davidge |
| D370,473 | S | 6/1996 | Derman |
| 5,548,981 | A | 8/1996 | Kirk |
| 5,579,657 | A | 12/1996 | Makous |
| 5,593,878 | A | 1/1997 | Knopf et al. |
| 5,603,416 | A | 2/1997 | Richardson et al. |
| 5,608,605 | A | 3/1997 | Siow et al. |
| 5,611,223 | A | 3/1997 | Spitzer |
| 5,622,064 | A | 4/1997 | Gluskoter et al. |
| 5,687,592 | A | 11/1997 | Penniman |
| 5,692,400 | A | 12/1997 | Bliven et al. |
| 5,709,110 | A | 1/1998 | Greenfield et al. |
| 5,722,268 | A | 3/1998 | Choi |
| 5,787,739 | A | 8/1998 | Derman |
| 5,791,171 | A | 8/1998 | Kelley |
| 5,799,520 | A | 9/1998 | Laabs et al. |
| 5,836,183 | A | 11/1998 | Derman |
| 5,870,281 | A | 2/1999 | Kim |
| 5,875,657 | A | 3/1999 | Kelley |
| 5,913,907 | A | 6/1999 | Lee |
| 5,963,131 | A | 10/1999 | D'Angelo et al. |
| 5,983,679 | A | 11/1999 | Reyes |
| 6,000,251 | A | 12/1999 | Murray et al. |
| 6,000,252 | A | 12/1999 | Murray et al. |
| 6,006,557 | A | 12/1999 | Carl et al. |
| 6,038,891 | A | 3/2000 | Zeren et al. |
| 6,058,744 | A | 5/2000 | Ling |
| 6,081,974 | A | 7/2000 | McDaid |
| 6,112,561 | A | 9/2000 | Carl |
| 6,112,562 | A | 9/2000 | Murray, Jr. et al. |
| 6,133,830 | A | 10/2000 | D'Angelo et al. |
| 6,155,088 | A | 12/2000 | Murray, Jr. et al. |
| 6,170,364 | B1 | 1/2001 | Johnson |
| 6,173,591 | B1 | 1/2001 | Derman |
| 6,199,413 | B1 | 3/2001 | McDaid et al. |
| 6,205,824 | B1 | 3/2001 | Miao |
| 6,212,918 | B1 | 4/2001 | Krautin |
| 6,227,017 | B1 | 5/2001 | Ingelmund |
| 6,244,080 | B1 | 6/2001 | Sakurai |
| 6,244,082 | B1 | 6/2001 | Avganim |
| 6,257,029 | B1 | 7/2001 | Liao |
| 6,265,974 | B1 | 7/2001 | D'Angelo et al. |
| 6,301,940 | B1 | 10/2001 | Derman et al. |
| 6,317,936 | B1 | 11/2001 | McDaid et al. |
| 6,360,405 | B1 | 3/2002 | McDaid et al. |
| 6,401,502 | B1 | 6/2002 | Yang |
| 6,449,992 | B1 | 9/2002 | Yu |
| 6,513,350 | B1 | 2/2003 | Hurd et al. |
| 6,553,794 | B1 | 4/2003 | Murray, Jr. et al. |
| 6,588,241 | B1 | 7/2003 | Murray, Jr. et al. |
| 6,591,642 | B1 | 7/2003 | Kuo |
| 6,619,080 | B1 | 9/2003 | Yu |
| 6,619,081 | B1 | 9/2003 | Yu |
| 6,735,990 | B1 | 5/2004 | Murray, Jr. et al. |
| 6,758,069 | B2 | 7/2004 | Derman |
| 6,886,376 | B2 | 5/2005 | Kuo |
| 7,150,168 | B1 * | 12/2006 | Kuo ..... 70/491 |
| 7,441,431 | B2 | 10/2008 | Weber et al. |
| 2003/0101778 | A1 | 6/2003 | Carl et al. |
| 2004/0040350 | A1 | 3/2004 | Derman |
| 2004/0206138 | A1 | 10/2004 | Murray et al. |
| 2005/0150262 | A1 | 7/2005 | Murray et al. |
| 2005/0150263 | A1 | 7/2005 | Murray et al. |
| 2005/0178173 | A1 | 8/2005 | Kuo |
| 2007/0033975 | A1 * | 2/2007 | Liu ..... 70/491 |

FOREIGN PATENT DOCUMENTS

| | | | |
|---|---|---|---|
| CA | 791364 | | 8/1968 |
| CA | 987121 | | 4/1976 |
| DE | 329934 | | 12/1920 |
| DE | 335741 | | 4/1921 |
| DE | 361068 | | 4/1923 |
| DE | 456219 | | 2/1928 |
| DE | 577757 | | 8/1932 |
| DE | 3202700 | | 8/1983 |
| DE | 3824393 | | 7/1989 |
| FR | 455740 | | 8/1913 |
| FR | 877220 | | 12/1942 |
| FR | 1026519 | | 4/1953 |
| FR | 1085107 | | 1/1955 |
| FR | 2308006 | | 11/1976 |
| FR | 2636686 | A1 | 3/1990 |
| GB | 447091 | | 5/1936 |
| GB | 1256295 | | 12/1971 |
| GB | 1376011 | | 12/1974 |
| GB | 2109109 | A | 5/1983 |
| GB | 2234856 | A | 2/1991 |
| IT | 451949 | | 10/1949 |
| JP | 37-7592 | | 4/1937 |
| JP | 49-91096 | | 11/1947 |

| | | |
|---|---|---|
| JP | 52-36813 | 3/1977 |
| JP | 57-25092 | 2/1982 |
| JP | 57-179618 | 11/1982 |
| JP | 2000-140948 | 5/2005 |
| NO | 14095 | 5/1905 |
| WO | WO 95/10680 | 4/1985 |
| WO | WO 86/00396 | 1/1986 |
| WO | WO 93/15295 | 8/1993 |
| WO | WO 96/07002 A1 | 3/1996 |

OTHER PUBLICATIONS

U.S. Appl. No. 09/007,225, Carl et al.
U.S. Appl. No. 09/007,674, Myers et al.
U.S. Appl. No. 95/000,116, Murray, Jr. et al.
U.S. Appl. No. 09/441,142, Murray et al.
U.S. Appl. No. 09/603,240, Murray et al.
U.S. Appl. No. 09/804,973, Murray et al.
U.S. Appl. No. 10/970,060, Merrem et al.
U.S. Appl. No. 11/000,397, Merrem et al.
Kablit Security System Catalog, pp. 7, 93, 1988. Computer and Office Equipment Security Catalog, 1990, Secure-It, Inc., 18 Maple Court, East Longmeadow, MA 01028.
Kensington Product Brochure for Kensington Apple Laser Writer and Macintosh Portable Security Systems, Computer and Office Equipment Security Catalog, 1990, Secure-In, Inc., 18 Maple Court, East Longmeadow, MA 01028.
Apple Security Bracket sold in AS kit.
Retaining Device Incorporated in Apple Cpmputers.
Kensington MicroSaver Computer Lock Box and Literature, 3 pages.
Kensingtom Product News Release; "Kensington Wins Case Protecting Cable Lock Status", 2003, 1 page.
ACCO Brands, Inc. v. Micro Security Devices, Inc. Federal Circuit Court Order Granting Defendant's Motion for Summary Judgement, Jul. 23, 2002, 13 pages.
Maltoni, D. et al.: "Handbook of Fingerprint Recognition"; Chapter 1: Introduction, 2003, Springer, New York, pp. 1-52.
Passproof User Manual 1990, 5 pages.
Flexguard Security System, Philadelphia Security Products (no date on page) (1 page).
Los Angeles Times, Jan. 12, 1969, Part V, p. 10.
Kensington Microsaver Packaging and Manual (copyright 1992), 4 pages.
Targus DEFCON 1 Ultra Notebook Computer Security System, User's Guide, copyright 2001.
PCT International Search Report, Application Serial No. PCT/US06/41843, Mar. 6, 2008, 1 page.

* cited by examiner

LOCKING DEVICE WITH PASSAGE

CROSS-REFERENCES TO RELATED APPLICATIONS

Not Applicable

BACKGROUND OF THE INVENTION

Recent news reports indicate that the plastic barrel of a certain type of pen can be used to open a certain type of tubular lock that is present on bicycle locks. According to the news reports, the plastic barrel can be inserted into the keyway of the tubular lock, and after some effort, the lock can be opened. The insertion of the plastic barrel into the keyway of a tubular lock can mold the plastic barrel to the shape of a key, and the molded barrel could be potentially used to turn the lock.

Improvements to deter this type of lock picking would be desirable.

BRIEF SUMMARY OF THE INVENTION

Embodiment of the invention are directed to lock devices, locking apparatuses, locking systems, and methods for using the same.

One embodiment of the invention is directed to a lock device for use with a key with an extended portion, the lock device comprising: a locking spindle including a plurality of locking spindle bores and a passage extending axially along an axial length of the locking spindle; a driver structure including a plurality of driver structure bores, wherein an interface between the driver structure and the locking spindle forms a shear line; a plurality of combination pins in the plurality of locking spindle bores; and a plurality of driver pins in the driver structure bores in the driver structure, the plurality of driver pins being respectively associated with the plurality of combination pins, wherein the passage is configured to receive the extended portion of the key, and wherein the extended portion extends to the shear line when the key is used to turn the locking spindle.

Another embodiment of the invention is directed to a locking apparatus comprising: a lock device comprising a locking spindle including a plurality of locking spindle bores and a passage extending axially along an axial length of the locking spindle, a driver structure including a plurality of driver structure bores, wherein an interface between the driver structure and the locking spindle forms a shear line, a plurality of combination pins in the plurality of locking spindle bores, and a plurality of driver pins in the driver structure bores in the driver structure, the plurality of driver pins being respectively associated with the plurality of combination pins; and a key including a coded portion and an extended portion, wherein the extended portion is configured to fit in the passage and extends to the shear line.

Another embodiment of the invention is directed to a method for using a lock device, the method comprising: inserting a key into a keyway of a lock device, wherein the key includes an extended portion that passes through a passage in a locking spindle in the lock device and to a shear line between the locking spindle and a driver structure; and turning the key.

Other embodiments of the invention are described in further detail below.

DETAILED DESCRIPTION

One embodiment of the invention is directed to a lock device for use with a key with an extended portion. The lock device may be a cylinder lock. In one embodiment, the lock device comprises a locking spindle including a plurality of locking spindle bores and a passage extending axially along an axial length of the locking spindle, and a driver structure including a plurality of driver structure bores. (As used herein, "along an axial length" includes a passage that extends at least partially along a portion of the locking spindle.) An interface between the driver structure and the locking spindle forms a shear line. The lock device also includes a plurality of combination pins in the plurality of locking spindle bores, and a plurality of driver pins in the driver structure bores in the driver structure, the plurality of driver pins being respectively associated with the plurality of combination pins. The extended portion of the key can extend exactly or approximately to the shear line to provide a temporary solid interface portion for the locking spindle. As a result, the driver pins in the driver structure stay on one side of the shear line when an authorized key is used to lock and/or unlock the lock device.

The lock devices according to embodiments of the invention can be used to secure or prevent the theft of any suitable types of articles. Such articles include bicycles, furniture, etc. However, the articles that can be secured by the lock devices according to embodiments of the invention are preferably portable electronic devices. Examples of portable electronic devices include portable computers (e.g., laptop computers), wireless phones, portable music players, DVRs (digital video recorders), flat panel displays and television sets, etc.

Figure 1:
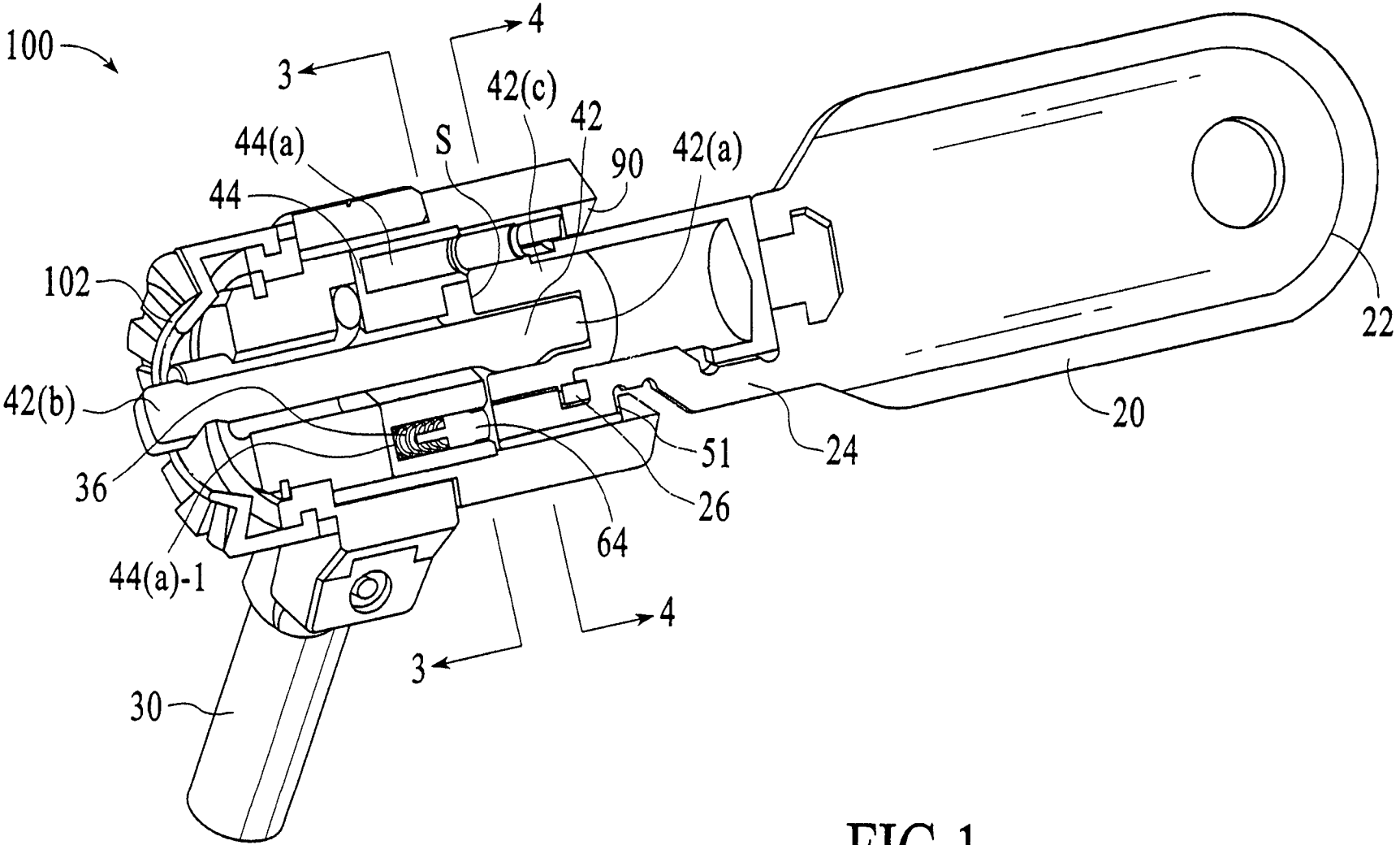
FIG. 1 discloses a cross-sectional perspective view of a lock assembly according to an embodiment of the invention.

FIG. 1 shows a locking apparatus 100 according to an embodiment of the invention. The locking apparatus 100 includes a key 20 and a lock device 102. These components, alone or in conjunction with other components, can form a locking apparatus according to an embodiment of the invention.

The key 20 includes a handle 22, an extended portion 26 and a coded portion 24 between the extended portion 26 and the handle 22. These features are described in further detail below.

The lock device 102 includes a housing 90. In this example, the housing 90 may include a tubular or cylindrical structure. It may be made of a material such as stainless steel or any other hard material.

A cable 30 or the like may be attached to the housing 90. The cable 30 may be a stainless steel cable or the like. In some embodiments, a distal end of the cable 30 may include a loop. To secure an article to an immovable object (e.g., a desk), the cable 30 may be looped around a portion of an immovable object (e.g., a leg of a desk) and the head of the lock device may pass through the loop. The lock device 102 may be attached to the article using a locking member that is present in the lock device 102. In some cases, the article may include a slot through which the locking member is inserted. The locking member may then be configured to a locked position to secure the head of the lock device to the article, and consequently to the immovable object.

Various components may be inside of the housing 90 of the lock device 102. For example, as illustrated in FIG. 1, a locking spindle 42 is cooperatively engaged with a driver structure 44 inside of the housing 90. In embodiments of the invention, the locking spindle 42 may rotate with respect to the driver structure 44. A shear line S may be defined by an interface between the driver structure 44 and the locking spindle 42.

The locking spindle 42 has a proximate end 42(*a*) near the front of the lock device 102 and a distal end 42(*b*) near the rear of the lock device 102. As shown in FIG. 1, the distal end 42(*b*) of the locking spindle 42 passes through the center of the driver structure 44. The locking spindle 42 can turn or rotate (clockwise or counterclockwise) relative to the driver structure 44, when the combination pins and driver pins do not lie across the shear line S.

The proximate end 42(*a*) includes a cylindrical portion including a number of locking spindle bores 42(*c*). The locking spindle bores 42(*c*) extend axially through the cylindrical portion of the locking spindle 42 at the proximate end 42(*a*) of the locking spindle 42. A plurality of combination pins (not shown) may be respectively disposed within the locking spindle bores 42(*c*). The combination pins can have different lengths and may correspond to the notched portions of the coded portion 24 of the key 20. If desired, the driver pins may also have different lengths.

A passage 51 is in the locking spindle 42 and is configured to receive the extended portion 26 of the key 20. The passage 51 may also have any suitable cross-sectional shape (e.g., a circular shape). In embodiments of the invention, the passage 51 may be in the form of an open channel at a side of the locking spindle 42, or may be in the form of a closed channel in the locking spindle 42. In either case, the passage 51 is configured to receive an extended portion 26 of the key 20 when the key 20 is being used to change the lock device 102 from a locked configuration to an unlocked configuration, or vice-versa. A distal end of the extended portion 26 of the key 20 extends to the shear line S to fill the passage 51 and to temporarily provide a solid surface for the locking spindle 42 at the interface S. As will be explained in further detail below, this prevents driver pins in the driver spindle bores 44(*a*) in the driver structure 44 from lying over the shear line S.

As shown in FIG. 1, the driver structure 44 may include a plurality of driver spindle bores 44(*a*). The driver spindle bores 44(*a*) also extend axially through the driver structure 44. They may also be disposed in a circle around a central axis of the driver spindle 44. Driver pins (not shown) may be respectively disposed within the driver spindle bores 44(*a*). A plurality of springs 36 may also be respectively disposed within the driver structure bores 44(*a*). These springs 36 push the driver pins (not shown) toward the shear line S.

During normal operation, one or more of the forwardly biased driver pins cross the shear line S when the locking device 102 is in a locked configuration. This prevents the locking spindle 42 from rotating relative to the driver structure 44 and prevents a locking member attached to the locking spindle 42 from moving. When the locking device 102 is in an unlocked configuration, the driver pins may be pushed rearward by corresponding combination pins in the locking spindle bores 42. The coded portion 24 of the key has cutouts of different depths so that the combination pins are pushed rearwardly different distances. When the combination pins are pushed rearward, the driver pins are on one side of the shear line S, while the combination pins are on the other side of the shear line S. Since the combination pins and the driver pins are separated from each other at the shear line S, this allows the locking spindle 42 to turn relative to the driver structure 44.

The driver and combination pins may be formed of any suitable structure and may be made of any suitable material. For example, the pins may be in the form of a peg, post, straight cylinder, a cylinder with a head, etc.

The operation of the passage 51 and the extended portion 26 of the key 20 will now be described. When the lock device 102 is in an unlocked position, the driver pin 64 may be biased toward the front of the lock device 102, may pass into a corresponding locking spindle bore 42(*c*), and may lie over the shear line S. In order to turn the locking spindle 42 and a locking member (not shown) attached to the locking spindle 42 to put the lock device 102 into an unlocked configuration, the key 20 is inserted in the keyway of the lock device 102 and the extended portion 26 of the key extends into the passage 51. The extended portion fills the passage 51 and keeps the driver pin 64 on one side of the shear line S as the locking spindle 42 rotates relative to the driver structure 44.

If one tries to insert an unauthorized tubular structure such as the barrel of a ballpoint pen into the keyway of the lock device 102, the molded barrel of the ballpoint pen cannot pass through the entire axial length of the passage 51. Even if the unauthorized user is successful in partially turning the locking spindle 42, the locking spindle 42 will still not be able to fully rotate. As the unauthorized user tries to turn the unauthorized tubular structure in the keyway of the lock device 102, the driver structure bore 44(*a*)-1 becomes aligned with the passage 51. Since there is no corresponding combination pin in the passage 51 and since the unauthorized tubular structure (not shown) does not fill the passage 51 to the shear line S, the driver pin 64 will be forward biased across the shear line S by the spring 36 when the passage 51 is aligned with the driver structure bore 44(*a*)-1. Consequently, the unauthorized user will not be able to completely turn the locking spindle 42 relative to the driver structure 44 and therefore cannot unlock the lock device 102.

In the preferred embodiment described above, the passage is configured to receive one of the driver pins if an unauthorized tubular structure is used to turn the locking spindle. However, a structure (e.g., a ball, cube, pyramid, etc.) other than a driver pin may be present in a driver spindle bore in other embodiments and may also prevent the use of an unauthorized tubular structure as a locking and/or unlocking device. In these alternative embodiments, the structure may lie in a driver spindle bore along with a biasing element such as a spring. The biasing element may bias the structure towards the shear line. If the key with the extended portion is inserted into the keyway of the lock device and if the extended portion extends to the shear line, the biased structure will remain on the driver spindle side of the shear line. If an unauthorized tubular structure is inserted into the keyway of the lock device, the unauthorized tubular structure cannot extend to the shear line. When the unauthorized tubular structure is used to turn the locking spindle, the driver spindle bore will become aligned with the passage. The biased structure will then pass into the passage and will lie over the shear line, thereby preventing further rotation of the locking spindle and preventing the authorized tubular structure from locking and/or unlocking the lock device.

Figure 2:
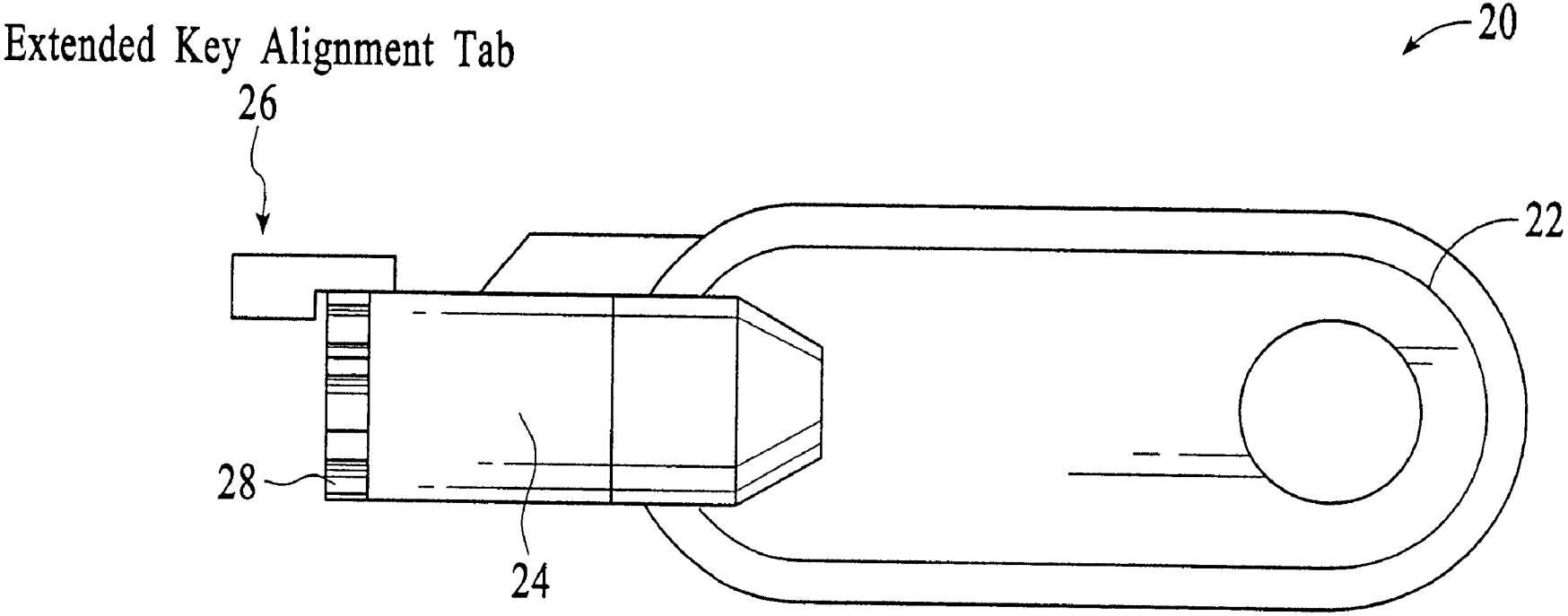
FIG. 2 discloses a side view of a key according to an embodiment of the invention.

FIG. 2 shows a key 20 according to an embodiment of the invention. The key 20 includes a handle 22, a coded portion 24 with notches 28 coupled to the handle 22, and an extended portion 26 extending from the coded portion 24. In this example, the coded portion 24 may be circular in shape.

The extended portion 26 may be an extended key alignment tab. The extended alignment tab can serve two functions. It can serve as an alignment guide for a user, so that the user can align the coded portion 28 of the key 20 with the keyway of the lock device 102. As indicated above, the alignment tab can also serve to fill the passage in the locking spindle down to the shear line in the lock device. This keeps the driver pins from entering the passage 51 in the locking spindle 42.

Figure 3:
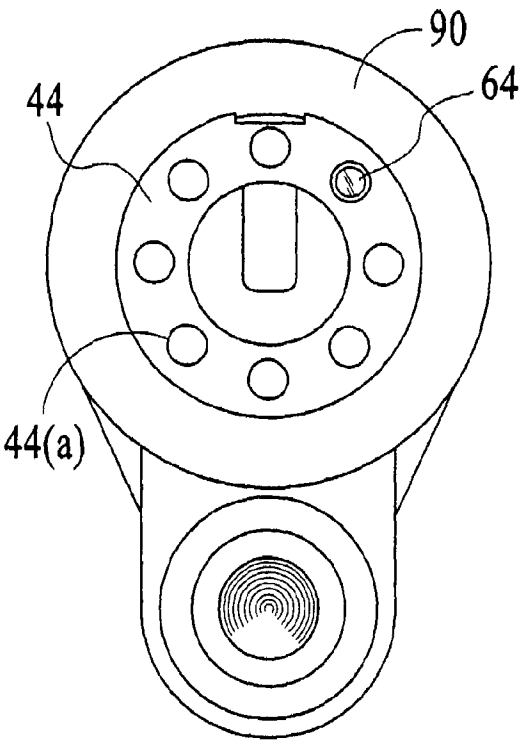
FIG. 3 shows a front, cross-sectional view of a lock device along the line 3-3 in FIG. 1.

FIG. 3 shows a front, cross-sectional view of the lock device along the line 3-3 in FIG. 1. As shown in FIG. 3, a number of driver structure bores 44(*a*) are present in the driver structure 44, which is disposed within the housing 90. In this example, there are six driver structure bores 44(*a*) arranged in a circle. One driver pin 64 is shown in one of the bores 44(*a*) for clarity of illustration. Normally, there would be one driver pin in each of the driver structure bores 44(*a*).

Figure 4:
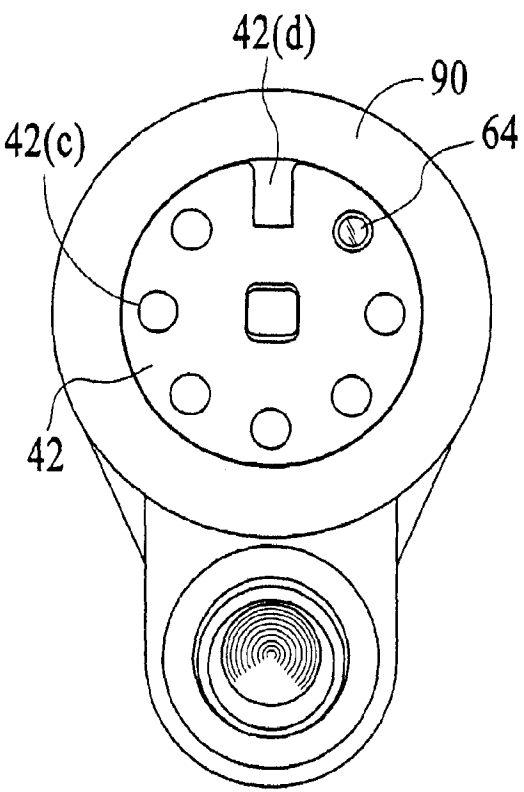
FIG. 4 shows a front, cross-sectional view of a lock device along the line 4-4 in FIG. 1.

FIG. 4 shows a front, cross-sectional view of the lock device along the line 4-4 in FIG. 1. As shown in FIG. 4, a number of locking spindle bores 42(*c*) are in the locking spindle 42. The locking spindle 42 is disposed in the housing 90. An alignment region 42(*d*) in the locking spindle 42 forms part of the previously described passage 51. The alignment region 42(*d*) is in the form of an open channel.

Figure 5:
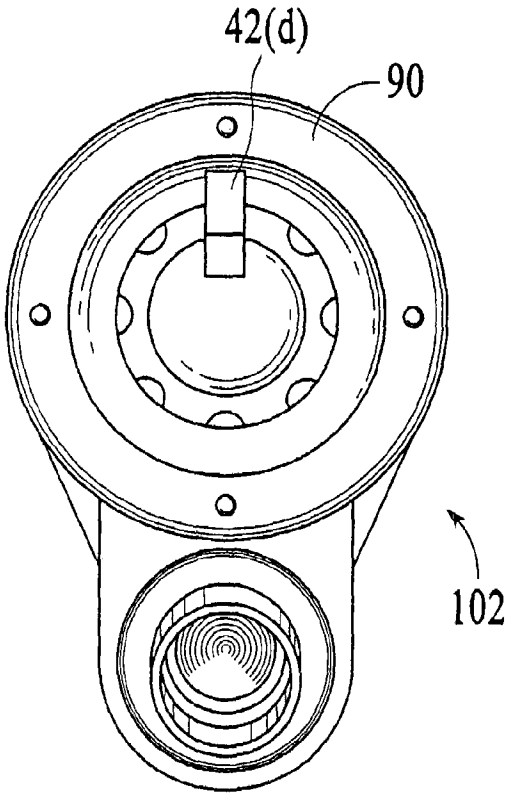
FIG. 5 shows a front view of a lock device according to an embodiment of the invention.

FIG. 5 shows a front view of a lock device 102 according of an embodiment of the invention. In FIG. 5, the alignment region 42(*d*) and the housing 90 are shown. The function of the alignment region and its corresponding passage are not immediately apparent to the end user or unauthorized user.

Figure 6:
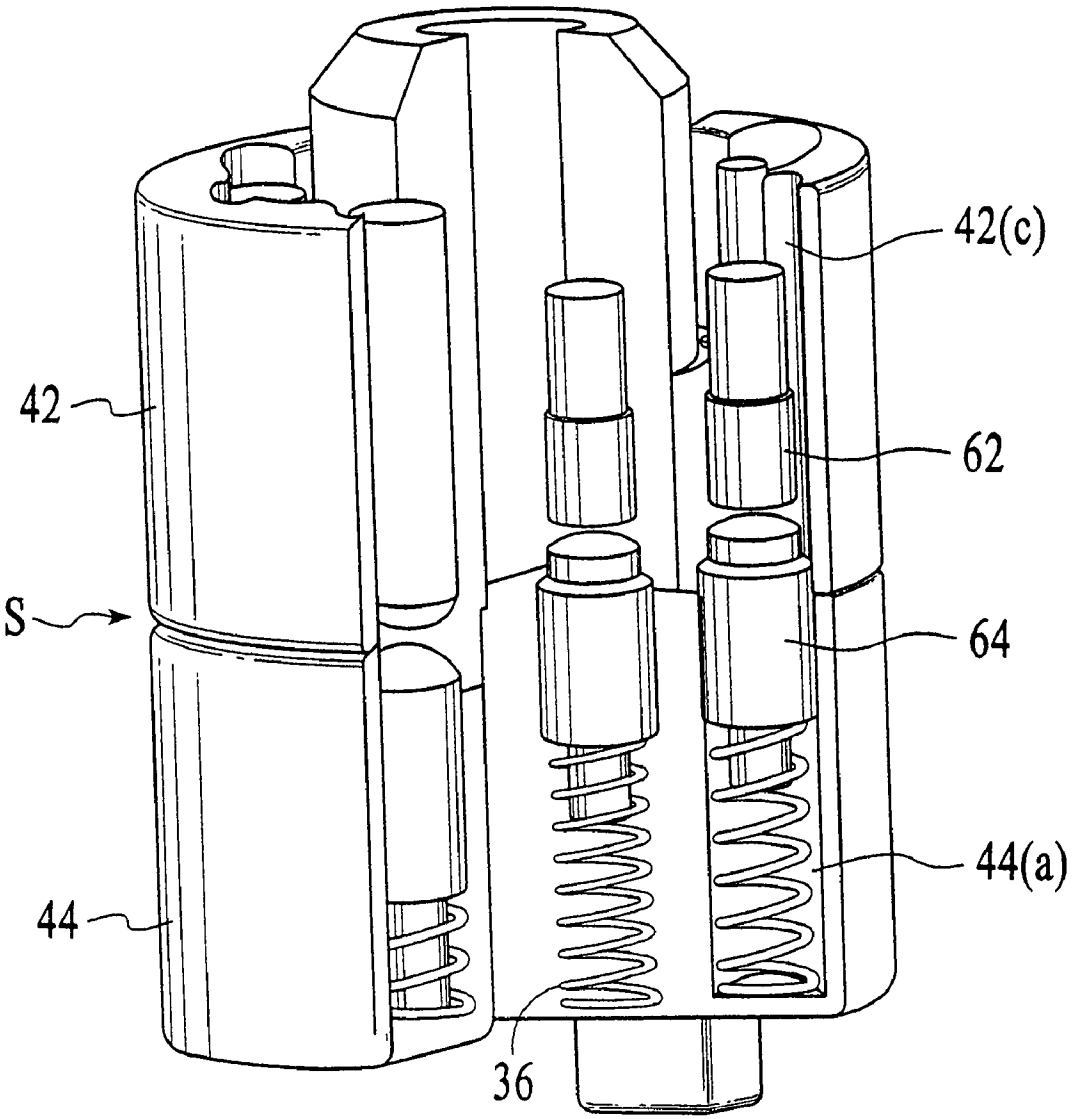
FIG. 6 is a perspective view of a lock device with a portion of the lock device being removed.

FIG. 6 shows a perspective, partial cut away view of a portion of the lock device. In this Figure, the combination pins 62 and driver pins 64 are more clearly illustrated. The combination pins 62 are within locking spindle bores 42(*c*) in the locking spindle 42. The driver pins 64 and corresponding springs 36 are within driver spindle bores 44(*a*) in the driver structure 44. An interface between the locking spindle 42 and the driver structure 44 forms a shear line S. As shown, when the driver pins 64 overlap with the shear line S, the locking spindle 42 cannot fully rotate with respect to the driver structure 44.

Figure 8:
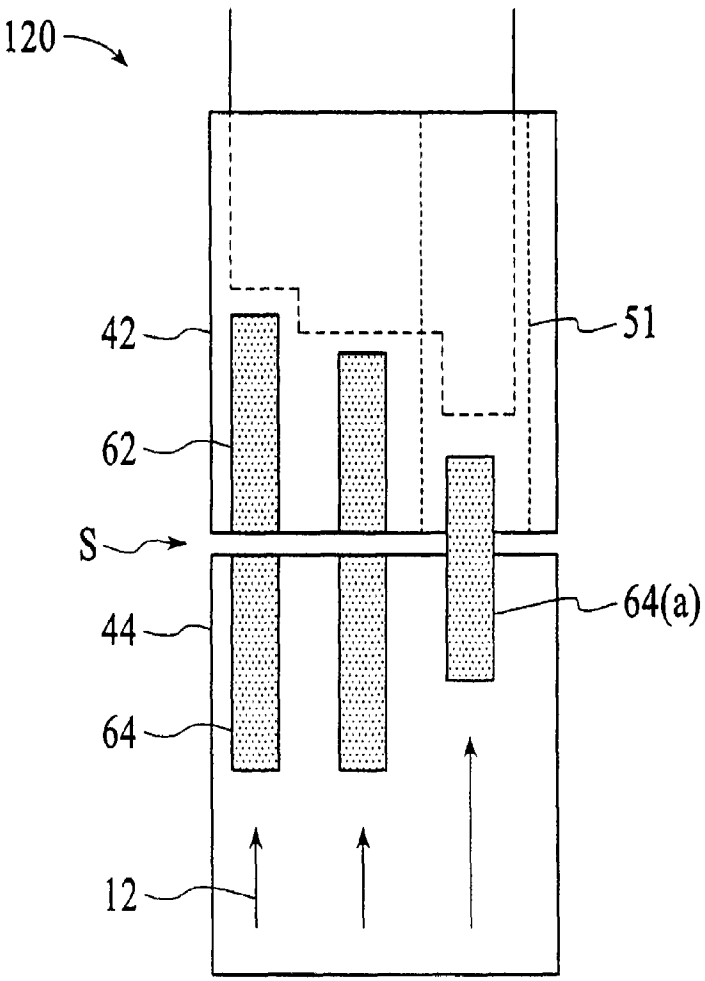
FIG. 8 shows a schematic view showing how the lock device would function if one tries to turn the locking spindle with an unauthorized tubular structure.
Figure 7:
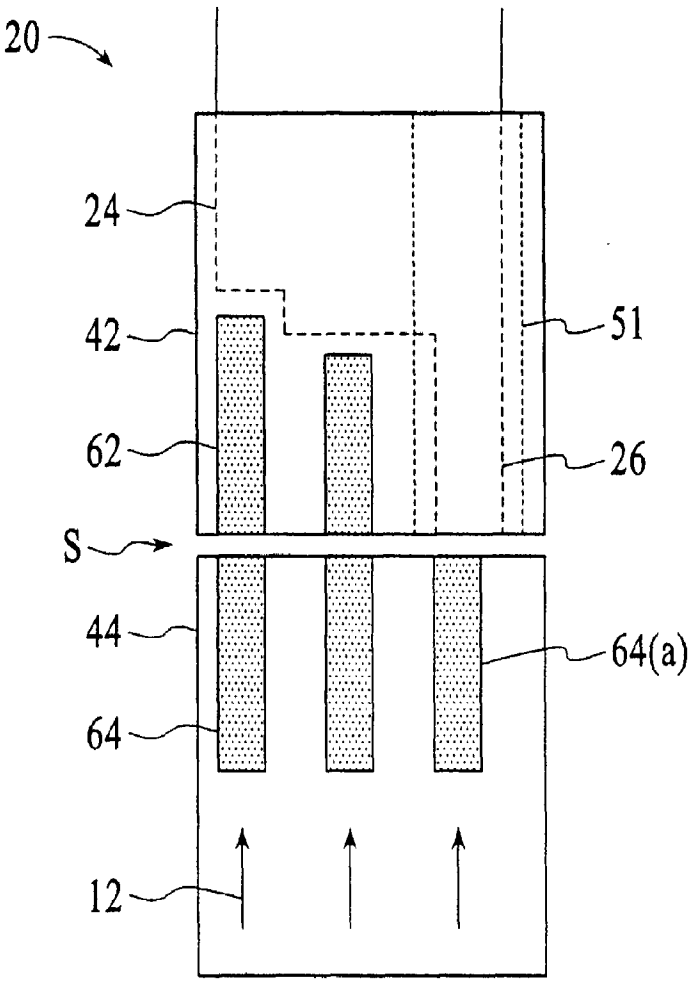
FIG. 7 shows a schematic view showing how a lock assembly according to an embodiment of the invention would work with a key having an extended alignment structure.

FIGS. 7 and 8 show how an authorized key and an unauthorized tubular structure may work in a lock device according to an embodiment of the invention. For clarity of illustration, pins are illustrated but their corresponding bores are not illustrated in these Figures.

FIG. 7 shows a schematic illustration of the how the driver and combination pins are positioned when an authorized key is used in the lock device. In this example, a key 20 is inserted into a keyway in a lock device. The coded portion 24 of the key 20 pushes the left pair of combination pins down, thereby pushing the driver pins 64 down under the shear line S. An extended portion 26 of the key 20 extends to the shear line S and passes through the passage 51. As a result, when the locking spindle 42 rotates with respect to the driver structure 44, each of the driver pins 64 stays below the shear line S.

FIG. 8 shows a schematic illustration of the how the driver and combination pins are positioned when an unauthorized tubular structure 120 is used in the lock device. As shown, when an unauthorized user tries to push the unauthorized tubular structure 120 into the keyway to turn the locking spindle 42, the deformed tubular structure 120 does not have a portion that extends all the way down to the shear line S. Consequently, when the unauthorized user tries to rotate the locking spindle 42, the driver pin 64(*a*) is biased upward into the passage 51, as shown by the arrows 12, and lies across the shear line S. This prevents the locking spindle 42 from rotating further with respect to the driver structure 44.

Figure 9:
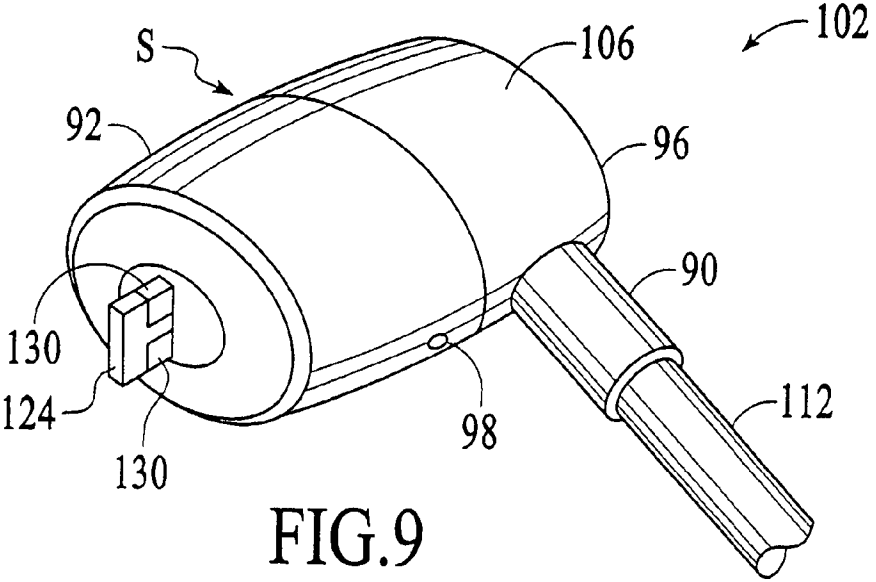
FIG. 9 shows a perspective view of another lock device according to another embodiment of the invention.

FIG. 9 shows a perspective view of a lock device according to another embodiment of the invention. The lock device includes a locking member 124 in the form of a cross-member or T-bar, and a pair of locking pins 130. The locking member 124 may be coupled to the previously described locking spindle so that it can rotate when the locking spindle rotates. As shown, the cross-bar portion of the locking member may be aligned with the pins 130. They may be inserted together into a security slot or the like.

Figure 10:
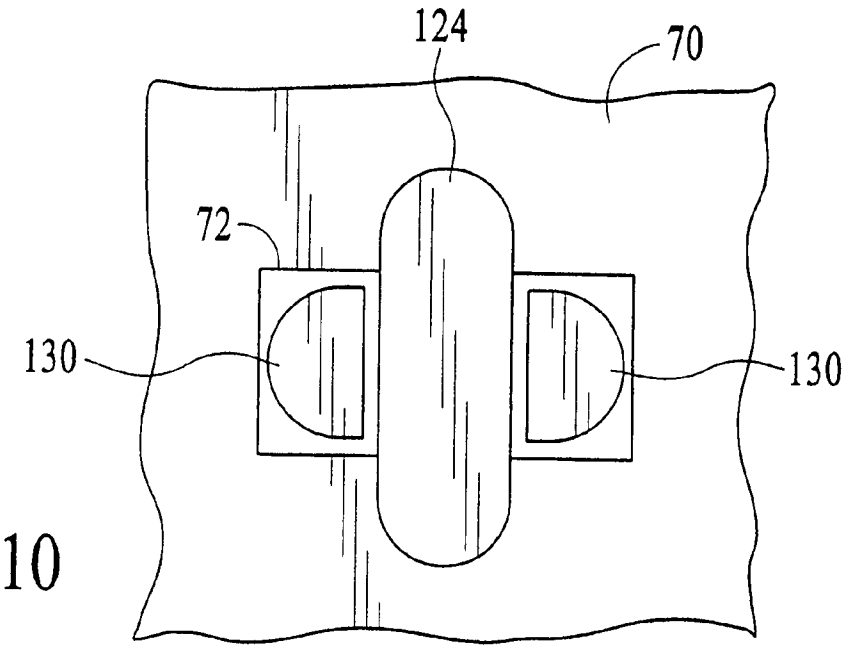
FIG. 10 shows pins and a locking member when they are present within a security slot in a housing of a portable electronic device.

FIG. 10 shows the pins and a locking member of a lock device extending through a security slot 72 in a housing 70 of a portable electronic device. As shown, after the cross-bar portion of the locking member is inserted into the slot with the pins, the locking member is turned so that the cross-bar is oriented perpendicular to the orientation of the slot 72. This secures the lock device to the housing 70. In embodiments of the invention, security slots that are generally rectangular and/or have dimensions of about 3 mm by about 7 mm are preferred. Small security slots do not significantly alter the aesthetic appearance of portable electronic devices, but can be used to deter theft. For example, if a thief tries to separate a lock device from a portable electronic device, the portable electronic device will be damaged, thereby impairing its value.

Other features that can be used in the lock devices according to embodiments of the invention are described in U.S. Pat. Nos. 6,006,557 and 5,502,989, which are herein incorporated by reference in their entirety for all purposes.

Embodiments of the invention provide for a number of advantages. For example, the presence of the elongated passage in the previously described locking spindle is not readily apparent to an unauthorized user. Thus, when the unauthorized user tries to pick the lock, the unauthorized user will not understand why the lock cannot be picked. In addition, embodiments of the invention are relatively easy to incorporate into a cylindrical lock and no elaborate modifications are needed.

The above description is illustrative and is not restrictive. Many variations of the invention will become apparent to those skilled in the art upon review of the disclosure. The scope of the invention should, therefore, be determined not with reference to the above description, but instead should be determined with reference to the pending claims along with their full scope or equivalents. Also, any one or more features of one embodiment may be combined with any one or more features of any other embodiment without departing from the spirit and the scope of the invention.

Any reference to positions such as "rear", "forward", "top", "bottom", "upper", "lower", etc. refer to the Figures and are used for convenience. They are not intended to refer to absolute positions.

A recitation of "a", "an" or "the" is intended to mean "one or more" unless specifically indicated to the contrary.

All patents, patent applications, publications, and descriptions mentioned above are herein incorporated by reference in their entirety for all purposes. None is admitted to be prior art.

What is claimed is:

1. A lock device for use with a key with an extended portion, the lock device comprising:

a locking spindle including a plurality of locking spindle bores and a passage extending axially along an axial length of the locking spindle;

a driver structure including a plurality of driver structure bores, wherein an interface between the driver structure and the locking spindle forms a shear line;

a plurality of combination pins in the plurality of locking spindle bores; and a plurality of driver pins in the driver structure bores in the driver structure, the plurality of driver pins being respectively associated with the plurality of combination pins, wherein the passage extends to the shear line and the extended portion of the key extends exactly to the shear line when the key is used to turn the locking spindle, wherein the passage is configured to receive at least one of the driver pins if an unauthorized structure is used to turn the locking spindle, and wherein the lock device further comprises a locking member coupled to a distal end of the locking spindle.

2. The lock device of claim 1 wherein the lock device is a cylinder lock.

3. The lock device of claim 1 wherein the locking member is in the form of a T-bar.

4. The lock device of claim 1 further comprising a housing disposed around the locking spindle and the driver structure, and a pair of parallel pins coupled to the housing.

5. The lock device of claim 1 wherein the passage coincides with an alignment tab region of the lock device.

6. The lock device of claim 1 further comprising a plurality of springs in the driver structure bores in the driver structure.

7. A locking apparatus comprising:

A lock device for use with a key with an extended portion, the lock device comprising:

a locking spindle including a plurality of locking spindle bores and a passage extending axially along an axial length of the locking spindle;

a driver structure including a plurality of driver structure bores, wherein an interface between the driver structure and the locking spindle forms a shear line;

a plurality of combination pins in the plurality of locking spindle bores;

a plurality of driver pins in the driver structure bores in the driver structure, the plurality of driver pins being respectively associated with the plurality of combination pins, wherein the passage extends to the shear line and the extended portion of the key extends exactly to the shear line when the key is used to turn the locking spindle, wherein the passage is configured to receive at least one of the driver pins if an unauthorized structure is used to turn the locking spindle, and wherein the lock device further comprises a locking member coupled to a distal end of the locking spindle; and the key, wherein the key further comprises a handle, and a coded portion between the handle and the extended portion, wherein the extended portion extends to the shear line when the key is used to lock or unlock the lock device.

8. The locking apparatus of claim 7 wherein the coded portion is circular.

9. The locking apparatus of claim 7 wherein the lock device further comprises a housing disposed around the locking spindle and the driver structure, and a pair of parallel pins coupled to the housing.

10. A security system comprising the locking apparatus of claim 7; and a portable electronic device, wherein the locking apparatus is used to secure the portable electronic device to an object other than the locking apparatus.

11. A locking apparatus comprising:

a lock device comprising a locking spindle including a plurality of locking spindle bores and a passage extending axially along an axial length of the locking spindle, a driver structure including a plurality of driver structure bores, wherein an interface between the driver structure and the locking spindle forms a shear line, a plurality of combination pins in the plurality of locking spindle bores, and a plurality of driver pins in the driver structure bores in the driver structure, the plurality of driver pins being respectively associated with the plurality of combination pins, wherein the passage is configured to receive at least one of the plurality of driver pins if an unauthorized structure is used to turn the locking spindle, and wherein the lock device further comprises a locking member coupled to a distal end of the locking spindle; and a key including a coded portion and an extended portion, wherein the extended portion is configured to fit in the passage and extend exactly to the shear line.

12. The lock apparatus of claim 11 wherein the lock device further comprises a housing disposed around the locking spindle and the driver structure.

13. A method for using a lock device, the method comprising:

inserting a key into a keyway of a lock device, wherein the key includes an extended portion that passes through a passage in a locking spindle in the lock device and exactly to a shear line between the locking spindle and a driver structure containing a plurality of driver pins, wherein the passage is configured to receive at least one of the plurality of driver pins if an unauthorized structure is used to turn the locking spindle;

turning the key; and attaching the lock device to a portable electronic device.

14. The method of claim 13 wherein the lock device is a cylinder lock.

15. The method of claim 13 wherein the lock device is attached to the portable electronic device using a slot that has dimensions of about 3 mm by about 7 mm and that is formed in a housing of the portable electronic device.

16. The method of claim 13 wherein the passage is an open passage.

* * * * *